US006926279B1

(12) United States Patent
Alvarado

(10) Patent No.: US 6,926,279 B1
(45) Date of Patent: Aug. 9, 2005

(54) MODULAR CHECKER GAME PIECES

(76) Inventor: Manuel E. Alvarado, 10 Taos Rd., Altadena, CA (US) 91001

( * ) Notice: Subject to any disclaimer, the term of this patent is extended or adjusted under 35 U.S.C. 154(b) by 45 days.

(21) Appl. No.: 10/623,848

(22) Filed: Jul. 22, 2003

(51) Int. Cl.[7] ..... A63F 3/00
(52) U.S. Cl. ..... 273/288; 273/260; 273/262
(58) Field of Search ..... 273/288, 289, 273/290, 260, 261, 262; 446/69, 72, 79, 97, 446/99–102; D21/386, 388, 389; 434/128

(56) References Cited

U.S. PATENT DOCUMENTS 1,211,590 A * 1/1917 Kennedy ..... 446/99
1,268,659 A * 6/1918 Wright ..... 273/290
1,746,839 A * 2/1930 Main et al. ..... 446/100
2,196,881 A 4/1940 Gruber
2,610,854 A * 9/1952 Card ..... 273/244
2,662,335 A * 12/1953 Calverley ..... 446/99
3,466,044 A * 9/1969 Somerville ..... 273/262
5,160,145 A 11/1992 Bokhagen
5,556,099 A * 9/1996 Mardirosian ..... 273/241
5,895,046 A 4/1999 Lee

* cited by examiner

*Primary Examiner*—Vishu K. Mendiratta

(57) ABSTRACT

Modular checker game pieces for playing a game of checkers includes a plurality of first base members. Each of the first base members resembles a lower body and includes an upper portion and a pair of legs that are attached to and extend downwardly from the upper portion. A plurality of second base members each resembles a horse having a saddle positioned thereon. Each of plurality of top pieces comprises an upper body. The top pieces each have a bottom surface. A plurality of couplers selectively couple each of the top pieces to one of the first or second base members.

2 Claims, 3 Drawing Sheets

MODULAR CHECKER GAME PIECES

BACKGROUND OF THE INVENTION

1. Field of the Invention

The present invention relates to game pieces and more particularly pertains to a new game piece for playing a game of checkers.

2. Description of the Prior Art

The use of game pieces is known in the prior art. These game pieces have had a variety of shapes, particularly in the realm of chess games. While these game pieces fulfill their respective, particular objectives and requirements, the need remains for game pieces tailored specifically for checkers and, more particularly, a way to distinguish between checkers which have been kinged and those which have not been kinged.

SUMMARY OF THE INVENTION

The present invention meets the needs presented above by including a plurality of first base members, each of the first base members resembles a lower body and includes an upper portion and a pair of legs that are attached to and extend downwardly from the upper portion. Each of a plurality of second base members resembles a horse having a saddle positioned thereon. Each of plurality of top pieces comprises an upper body. The top pieces each have a bottom surface. A plurality of couplers selectively couple each of the top pieces to one of the first or second base members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
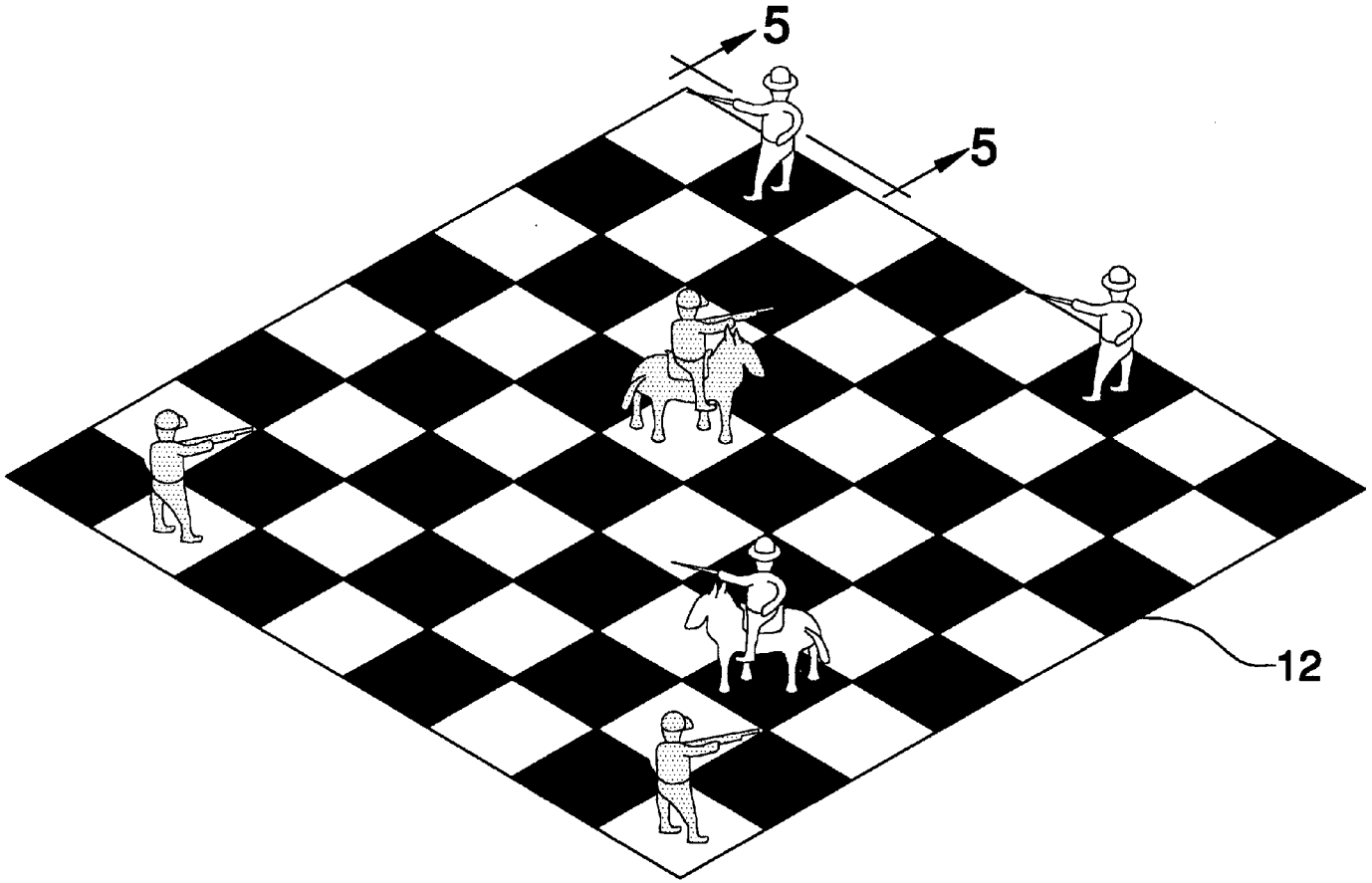
FIG. 1 is a schematic perspective view of a modular checker game pieces according to the present invention.
Figure 2:
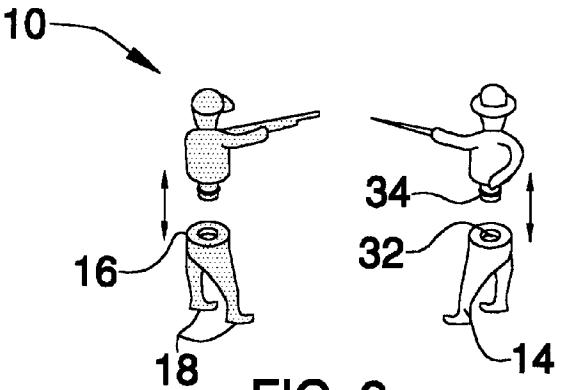
FIG. 2 is a schematic perspective view of the present invention.
Figure 3:
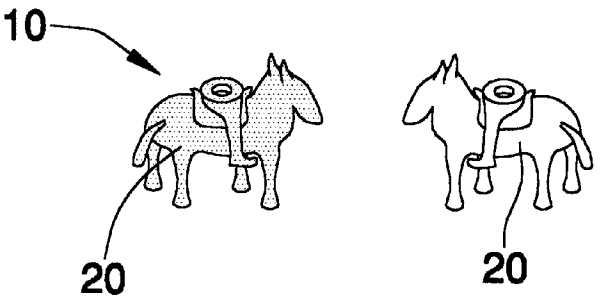
FIG. 3 is a schematic perspective view of the present invention.
Figure 4:
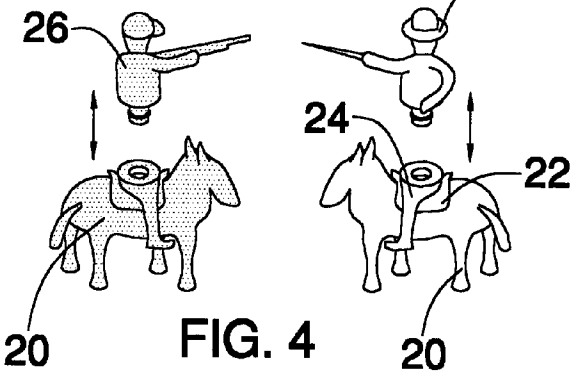
FIG. 4 is a schematic perspective view of the present invention.
Figure 5:
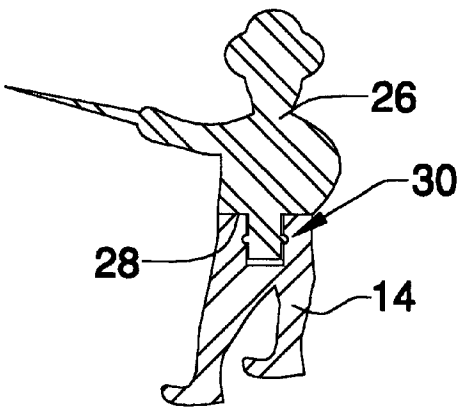
FIG. 5 is a schematic cross-sectional view taken along line 5—5 of FIG. 1 of the present invention.
Figure 6:
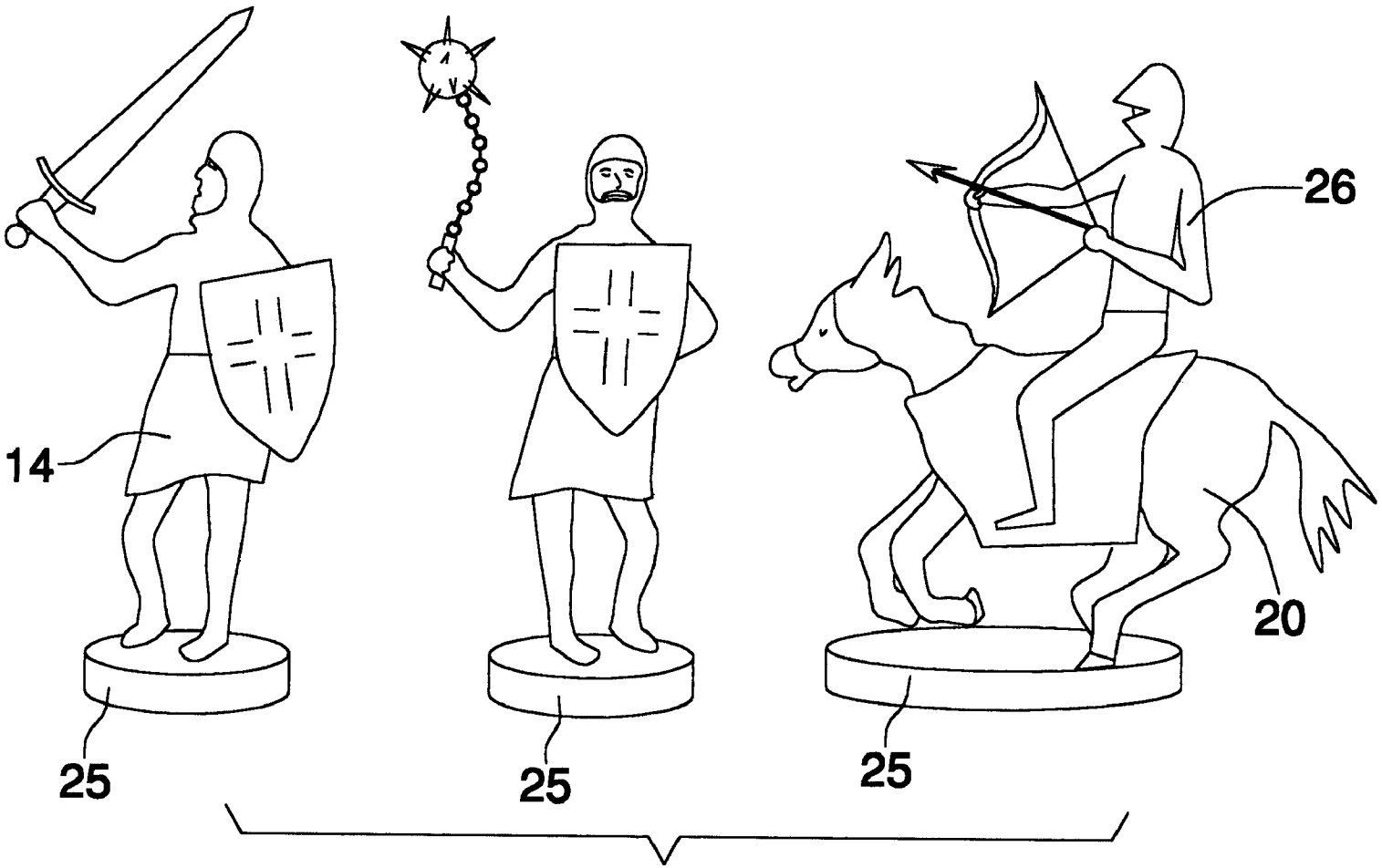
FIG. 6 is a schematic perspective view of a second embodiment of the game pieces of the present invention.

With reference now to the drawings, and in particular to FIGS. 1 through 6 thereof, a new game piece embodying the principles and concepts of the present invention and generally designated by the reference numeral 10 will be described.

As best illustrated in FIGS. 1 through 6, the modular checker game pieces 10 generally comprise checker game pieces for use in playing a conventional game of checkers on a conventional checker board 12. The game pieces 10 include a plurality of first base members 14. Each of the first base members 14 preferably resembles a lower body of soldier or a knight and includes an upper portion 16 and a pair of legs 18 that are attached to and extends downwardly from the upper portion 16.

A plurality of second base members 20 each resembles a horse having a saddle 22 positioned thereon. Preferably, a lower body 24 of soldier or knight is positioned on the saddle 22. Additionally, plates 25 may be added to the first 14 and second 20 base members for adding stability to such.

The game pieces 10 include a plurality of top pieces 26 that each have a bottom surface 28. Each of the top pieces 26 comprises an upper body. Each of the upper bodies resembles a knight that is carrying a weapon and a shield. Alternatively, each of the upper bodies may resemble a civil war soldier that is preferably carrying a gun or a sword.

A plurality of couplers 30 are used for selectively coupling each of the top pieces 26 to one of the first 14 or second 20 base members. Each of the couplers 30 preferably includes a female coupler 32 and a male coupler 34. The female couplers 30 are positioned on each of the upper portions 16 and on each of the saddles 22. The male couplers 34 are each positioned on one of the bottom surfaces 28 of the top pieces 26.

In use, the checker game is played using conventional rules and with the top pieces 26 coupled to the first base members 14. As the game piece is moved to the other side of the board 12 and "kinged," so that it may, according to the rules of checkers, move in both directions across the checker board, the first base member 14 is replaced with one of the second base members 20. This signifies that the game piece 10.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A game assembly for playing a game checkers comprising:

a game board, said game board having a plurality of squares thereon and defining a checker board;

a plurality of first base members, each of said first base members resembling a lower body and including an upper portion and a pair of legs being attached to and extending downwardly from said upper portion;

a plurality of second base members, each of said second base members resembling a horse having a saddle positioned thereon;

a plurality of top pieces, each of said top pieces comprising an upper body, each of said upper bodies resembling a knight and carrying a weapon and a shield, each of said top pieces having a bottom surface; and a plurality of couplers for selectively coupling each of said top pieces to one off said first or second base members, each of said couplers including a female coupler positioned on one of said upper portions and said saddles and a male coupler being positioned on one of said bottom surfaces of said top pieces.

2. A game assembly for playing a game checkers comprising:

a game board, said game board having a plurality of squares thereon and defining a checker board;

a plurality of first base members, each of said first base members resembling a lower body and including an upper portion and a pair of legs being attached to and extending downwardly from said upper portion;

a plurality of second base members, each of said second base members resembling a horse having a saddle positioned thereon;

a plurality of top pieces, each of said top pieces comprising an upper body, each of said upper bodies resembling a civil war soldier, each of said top pieces having a bottom surface; and a plurality of couplers for selectively coupling each of said top pieces to one of said first or second base members, each of said couplers including a female coupler positioned on one of said upper portions and said saddles and a male coupler being positioned on one of said bottom surfaces of said top pieces.

* * * * *